United States Patent [19]

Ogasawara et al.

[11] Patent Number: 4,657,604

[45] Date of Patent: Apr. 14, 1987

[54] FINE AMORPHOUS METAL WIRES

[75] Inventors: Isamu Ogasawara; Kiyotsugu Maekawa; Hiroyuki Tomioka; Shinji Furukawa, all of Kyoto, Japan

[73] Assignee: Unitika Ltd., Japan

[21] Appl. No.: 889,709

[22] Filed: Jul. 28, 1986

[30] Foreign Application Priority Data

Jul. 26, 1985 [JP] Japan ..... 60-166560
Jul. 26, 1985 [JP] Japan ..... 60-166561

[51] Int. Cl.[4] ..... H01F 1/04

[52] U.S. Cl. ..... 148/304; 148/403; 148/425; 420/435; 420/440

[58] Field of Search ..... 148/31.55, 403, 425; 420/435, 440

[56] References Cited

U.S. PATENT DOCUMENTS

| | | | |
|---|---|---|---|
| 4,420,348 | 12/1983 | Shiiki et al. | 148/403 |
| 4,473,417 | 9/1984 | Inomata et al. | 148/403 |
| 4,488,195 | 12/1984 | Yanagiuchi et al. | 148/403 |
| 4,517,017 | 5/1985 | Inomata et al. | 148/403 |
| 4,523,626 | 6/1985 | Masumoto et al. | 164/463 |
| 4,527,614 | 7/1985 | Masumoto et al. | 164/463 |

FOREIGN PATENT DOCUMENTS 0050479 4/1982 European Pat. Off. .

*Primary Examiner*—John P. Sheehan
*Attorney, Agent, or Firm*—Sughrue, Mion, Zinn, Macpeak, and Seas

[57] ABSTRACT

A fine amorphous metallic wire having a circular cross section and stability to a bias magnetic field, said wire being composed of an alloy having the following composition formula $$(Co_{1-a-b}Fe_aM_b)_{100-x-y}Si_xB_y$$

wherein M is at least one element selected from Cr, Mo, Ni, Nb, Ta, Pd, Pt, and Cu, $x<20$ atomic %, 7 atomic % $\leqq y<35$ atomic %, 7 atomic % $<x+y\leqq 35$ atomic %, $0.01\leqq a\leqq 0.1$, and $0.001\leqq b\leqq 0.05$. The fine amorphous metallic wire has low magnetostriction, high magnetic permeability, high saturation magnetic flux density, and excellent toughness, and is stable against a bias magnetic field. Hence, it can be used as a material for electromagnetic devices such as a coordinate reading device, a current sensor, an eddy current sensor, a magnetic sensor, or a displacement sensor.

10 Claims, No Drawings

FINE AMORPHOUS METAL WIRES

FIELD OF THE INVENTION

This invention relates to fine amorphous metallic wires which are circular in cross section and have stable properties against a bias magnetic field while retaining the excellent properties of Co-type amorphous alloys such as low magnetostriction, high magnetic permeability, and high saturation magnetic flux density.

BACKGROUND OF THE INVENTION

Amorphous magnetic alloy materials have been extensively studied for commercialization because of their excellent electromagnetic properties. Particularly, Co-Fe-Si-B type amorphous alloys of specific compositions can achieve very low magnetostriction, and are very much expected to find applications as materials for magnetic heads, magnetic sensors, etc. Attempts have been actively made to improve their electromagnetic properties such as magnetic permeability and magnetic flux density by adding various elements to the Co-Fe-Si-B type amorphous alloys. For example, there are amorphous alloys in ribbon form having increased magnetic permeability as a result of adding suitable amounts of elements such as Nb, Ni, V, Ta, Ti, Zr, Cr, Mo, and W, as described, e.g., in Japanese Patent Application (OPI) Nos. 72715/79, 89918/79, 107826/79, 107827/79, 13137/82, and 31053/83 (The term "OPI" as used herein refers to a "published unexamined Japanese patent application.").

Japanese Patent Application (OPI) No. 79052/82 (corresponding to U.S. Pat. No. 4,527,614 and European Patent 50,479) discloses high-quality Co-type fine amorphous metallic wires circular in cross section which have a very uniform shape with a circularity of at least 90% and a diameter variation of not more than 4%.

Amorphous metallic ribbons produced by the one roll method by the present inventors from conventional Co-type amorphous metals, for example, an alloy having the composition $(Co_{0.92}Fe_{0.06}Cr_{0.02})_{75}Si_{10}B_{15}$ or an alloy having the composition $(Co_{0.92}Fe_{0.06}Ta_{0.02})_{75}Si_{10}B_{15}$ described in Japanese Patent Application (OPI) No. 107827/79, an alloy having the composition $(Co_{0.91}Fe_{0.06}Nb_{0.03})_{77}Si_{15}B_8$ described in Japanese Patent Application (OPI) No. 31053/83, and an alloy having the composition $(Co_{0.92}Fe_{0.06}Ni_{0.02})_{78}Si_{13}B_9$ or an alloy having the composition $(Co_{0.91}Fe_{0.06}Mo_{0.03})_{78}Si_{13}B_9$ described in Japanese Patent Application (OPI) No. 13137/82 had low magnetostriction, high magnetic permeability, and high saturation magnetic flux density, but when a bias magnetic field was applied thereto, the magnetic permeability decreased abruptly. Specifically, when amorphous metallic ribbons having a thickness of about from 5 to 100 microns (μm) and a width of from 2 to 100 mm were produced by jetting a molten mass of a Co-Fe-Cr-Si-B type alloy, a Co-Fe-Mo-Si-B type alloy, or a Co-Fe-Ni-Si-B type alloy onto a rotating cooling roll made of a material having high thermal conductivity such as a copper, these ribbons markedly decreased in magnetic permeability under the influence of a bias magnetic field.

Such ribbon which decreases in magnetic permeability in a bias magnetic field cannot be used in practical applications because when it is applied, for example, to a coordinates reading device, signals obtained become abruptly weak due to even a slight bias magnetic field, for example by the influence of the earth's magnetism owing to the differences in the directions of east, west, south, and north, or by the influence of a magnetized body near the measuring instrument.

The Co-type fine amorphous metallic wires described in Japanese Patent Application (OPI) No. 79052/82 have superior electromagnetic properties and corrosion resistance, but their magnetic permeability decreases under the influence of a bias magnetic field. Hence, they are not fully acceptable as a material for a coordinates reading device, for example.

SUMMARY OF THE INVENTION

One object of this invention is to provide an amorphous electromagnetic alloy material which is substantially invulnerable to influences of a bias magnetic field while retaining the low magnetostriction, high magnetic permeability, and high saturation magnetic flux density characteristics of Co-type amorphous alloy.

The present inventors have made extensive investigations in order to achieve this object, and have found that fine amorphous metallic wires having substantial invulnerability to a bias magnetic field and an increased permeability without a decrease in saturation magnetic flux density can be obtained by adding a specific amount of at least one of Cr, Mo, Ni, Nb, Ta, Pd, Pt, and Cu to an alloy of Co, Fe, Si, and B in specific proportions, and processing the resulting alloy such that the resulting wires have a circular cross section.

According to this invention, there is provided a fine amorphous metallic wire having a circular cross section and stability to a bias magnetic field, said wire being composed of an alloy having the composition formula $$(Co_{1-a-b}Fe_aM_b)_{100-x-y}Si_xB_y$$

wherein M is at least one element selected from Cr, Mo, Ni, Nb, Ta, Pd, Pt, and Cu, and $x<20$ atomic%, 7 atomic% $\leqq y<35$ atomic%, 7 atomic% $<x+y\leqq 35$ atomic%, 0.01 atomic% $\leqq a\leqq 0.1$ atomic%, and $0.001\leqq b\leqq 0.05$.

The fine amorphous metallic wire has low magnetostriction, high magnetic permeability, high saturation magnetic flux density, and excellent toughness, and is stable to a bias magnetic field. Hence, it is very useful as a material for electromagnetic devices such as coordinates reading devices, current sensors, eddy current sensors, magnetic sensors, displacement sensors, etc., to which the application of conventional Co-type amorphous alloys is difficult.

The fine amorphous metallic wire of this invention also has excellent corrosion resistance and fatigue characteristics, and does not involve any trouble during use in a corrosive atmosphere or at sites which are subject to strains.

DETAILED DESCRIPTION OF THE PREFERRED EMBODIMENTS

The fine amorphous metallic wire of this invntion is a material having low magnetostriction, high magnetic permeability, high saturation magnetic flux density, substantial invulnerability to influences of a bias magnetic field, and excellent toughness. To obtain these properties, the composition of the alloy should be limited as described below.

The total sum of Si and B should exceed 7 atomic% but not be more than 35 atomic%, and preferably is at least 15 atomic% but not more than 32 atomic%. If the total of Si and B is 7 atomic% or less, or more than 35 atomic%, an amorphous single phase fine metallic wire cannot be obtained, and the resulting fine metallic wire has poor toughness, which creates serious problems in after-processing. This is not industrially desirable.

Within the above specified total amount of Si and B, the proportion of Si should be less than 20 atomic%, and preferably is at least 7.5 atomic% but not more than 17.5 atomic%. If the proportion of Si is 20 atomic% or above, an amorphous single phase fine metallic wire cannot be obtained, and the resulting metallic wire has poor toughness.

Likewise, the proportion of B should be at least 7 atomic% but less than 35 atomic%, and preferably is at least 7.5 atomic% but not more than 25 atomic%. If the proportion of B is less than 7 atomic% or at least 35 atomic%, the resulting metallic wire has poor toughness.

Taking the total of Co, Fe, and M as 1, the proportion of Fe should be at least 0.01 but not more than 0.1. If the proportion of Fe exceeds 0.1, the magnetostriction increases on the positive side. If the proportion of Fe is less than 0.01, the magnetostriction increases on the negative side.

M is at least one element selected from Cr, Mo, Ni, Nb, Ta, Pd, Pt, and Cu. Its proportion should be at least 0.001 but not more than 0.05, and preferably is at least 0.003 but not more than 0.04. If it exceeds 0.05, the magnetic permeability of the fine wire decreases very much and the wire is not practical. If it is less than 0.001, no effect due to the adding of the element M is observed, and the magnetic permeability is greatly decreased by the influence of a bias magnetic field. The fine metallic wire of this invention may contain impurities in amounts present in ordinary industrial materials.

To produce the fine wire of this invention, the above alloy can be melted and quenched and solidified by a spinning method in a rotating liquid which is particularly preferably used in this invention. The spinning method in a rotating liquid is described, for example, in Japanese patent Application (OPI) No. 165016/81 (corresponding to U.S. Pat. No. 4,523,626 and European Pat. No. 39,169) and Japanese patent application (OPI) No. 79052/82 (corresponding to U.S. Pat. No. 4,527,614 and European Pat. No. 50,479). Specifically, water is put into a rotating drum, and a water film is formed on the inner wall of the drum by centrifugal force. The molten alloy is jetted into the water film from a spinning nozzle having an orifice diameter of from about 80 to 200 microns ($\mu$m) to form a fine wire having a circular cross section. To obtain a uniform continuous fine wire, it is desirable to make the peripheral speed of the rotating drum equal to, or higher than, the speed of the molten metal flow jetted from the spinning nozzle, and particularly preferbly higher than the speed of the molten metal flow by from 5 to 30%. Preferably, the angle formed between the molten metal flow jetted from the spinning nozzle and the water film formed on the inner wall of the drum is at least 20°. Further, the fine wire of this invention can be produced by the other methods, for example, Kanesh method as described in U.S. Pat. No. 3,845,805.

The fine amorphous metallic wire of this invention generally has a diameter of about from 50 to 250 micrometers and a circularity of at least 60% (method of determination described below), preferably at least 80%, especially preferred at least 90%, and preferably has a uniform shape shown by a diameter variation of not more than 4%.

The fine wire of this invention has low magnetostriction, high magnetic permeability, high saturation magnetic flux density, and excellent toughness, and hardly decreases in magnetic permeability when subjected to a bias magnetic field. For example, a fine amorphous metallic wire composed of $(Co_{0.91}Fe_{0.06}\text{-}Mo_{0.03})_{72.5}Si_{12.5}B_{15}$ having a circular cross section and high quality can be bent by 180° bending property and has excellent toughness, a magnetic flux density ($B_{20}$) under the application of a magnetic field of 20 Öe of 7.3 KG, a magnetic permeability ($\mu_{100}$) at a frequency of 100 KHz of as high as 1805, and a magnetostriction of nearly zero. Its Hc is 0.064 Öe, which is higher than the Hc (0.036 Öe) of a conventional fine amorphous metallic wire composed of $(Co_{0.94}Fe_{0.06})_{72.5}Si_{12.5}B_{15}$. Thus, this fine amorphous metallic wire is substantially invulnerable to the influences by a bias magnetic field, and is magnetically stable. However, an amorphous ribbon having the composition $(Co_{0.91}Fe_{0.06}Mo_{0.03})_{72.5}Si_{12.5}B_{15}$ has approximately the same toughness and $B_{20}$ value as the fine amorphous metallic wire of this invention having the same composition, but has a $\mu_{100}$ of as low as 800 and an Hc value of as low as 0.007 Öe, and therefore is influenced by even a slight bias magnetic field such as the earth's magnetism and decreases greatly in magnetic permeability. For example, when such ribbon is used in a coordinates reading device or the like, signals obtained may sometimes become very small, and its stability to a bias magnetic field is extremely low.

High-quality fine amorphous magnetic metallic wires having the composition $(Co_{0.93}Fe_{0.065}Nb_{0.005})_{72.5}Si_{12.5}B_{15}$ and a circular cross section can be bent by 180° bending property and have excellent toughness. They have a magnetic flux density ($B_{20}$), under the application of a magnetic field of 20 Öe, of 7.5 KG, a magnetic permeability ($\mu_{100}$) at a frequency of 100 KHz of as high as 1940, and a magnetostriction of nearly zero. They are substantially invulnerable to influences of a bias magnetic field, and are magnetically stable. However, an amorphous ribbon having the same composition $(Co_{0.93}\text{-}Fe_{0.065}Nb_{0.005})_{72.5}Si_{12.5}B_{15}$ has similar toughness and $B_{20}$ to the fine amorphous metallic wires of this invention having the same composition, but has a $\mu_{100}$ of as low as 950 and an Hc of as low as 0.003 Öe. Hence, it undergoes effects of a slight bias magnetic field such as the earth's magnetism and greatly decreases in magnetic permeability. When such ribbon is used, for example, in a coordinate reading device, the signals obtained may become very small, and its stability to a bias magnetic field is very low.

The fine amorphous metallic wire of this invention is stable against a bias magnetic field, and particularly has a $V_H$ value, defined hereinbelow, of not more than 1.5, preferably not more than 1.2, more preferably not more than 0.75, showing better stability than conventional ribbon having a $V_H$ of from 2.1 to 2.6.

The following examples illustrate the present invention more specifically. However, the invention is not limited to these examples.

EXAMPLES 1 TO 25 AND COMPARATIVE EXAMPLES 1 TO 35

In each run, each of Co type alloys and Co-Fe-Si-B-M type alloys having the compositions shown in Table 1 was melted in an argon gas atmosphere, and jetted from a quartz glass spinning nozzle having an orifice diameter of 0.13 mm under an argon gas jetting pressure of 4.5 kg/cm$^2$ into a cooling liquid, 25 mm deep, kept at a temperature of 4° C. and formed within a cylindrical drum having an inside diameter of 500 mm and rotating at a speed of 300 rpm to quench and coagulate the molten alloy and to produce a continuous fine amorphous metallic wire having a circular cross section and a diameter of 120 microns (μm).

At this time, the distance between the spinning nozzle and the surface of the rotating cooling liquid was maintained at 3 mm, and the angle formed between the molten metal stream jetted out from the spinning nozzle and the surface of the rotating cooling liquid was about 65°.

For comparison, an amorphous alloy ribbon having the composition shown in Table 1 and a flat cross section was produced by jetting out the molten alloy onto a rotating cooling roll composed of copper (Comparative Examples 3, 4, 7, 10, 15, 16, 23, 24, 29, and 30).

The electromagnetic properties, 180° bending property, and shape of the resulting amorphous alloy wire or ribbon were measured, and the results are summarized in Table 1.

The circularity was determined by selecting 10 points in the lengthwise direction of the continuous fine wire, and calculating an average of the ratios ($r/R \times 100(\%)$) of the long diameters (R) and the short diameters (r) of the cross sections of these points.

The diameter variation was determined by a coefficient of variation of the average wire diameter obtained by causing the fine wire to run 50 m by a laser wire diameter measuring instrument (SLG-104 type, made by Shin Nippon Kagaku Seisakusho Co., Ltd.) and measuring the continuous average wire diameter. That is, its diameter variation means a coefficient of variation of a long diameter in the lengthwise direction which is represented by the formula ($\sigma_n/n \times 100(\%)$), wherein x is an average of the diameters measured at each points in the lengthwise direction of the wire when caused the wire to run 50 m, and $\sigma_n$ is a standard deviation of the measured values at each portion.

The coercivity Hc at a.c. 50 Hz and the magnetic flux density $B_{20}$ at 20 Öe were measured from an a.c. magnetization curve determined by a BH curve tracer made by Riken Electronics Co., Ltd.

The magnetic permeability μ(10 mÖe, 100 KHz) was measured by an impedance analyzer (4192 ALF, made by YHP) on a fine wire or ribbon sample having a length of 40 cm inserted into a coil.

The magnetostriction was measured by using a magnetostriction measuring device made by Naruse Scientific Machine Co., Ltd.

The stability to a bias magnetic field, indicated by the $V_H$ value in Table 1 below, was determined as follows: by using an impedance analyzer, the magnetic permeability μ(100 KHz) of a sample was measured while the bias magnetic field was continuously varied from 0 Öe to 0.4 Öe in the axial direction of the sample. From the bias magnetic field-permeability curve, the variation $V_H$ of the magnetic permeability with respect to the bias magnetic field was calculated in accordance with the equation $$V_H = \frac{\log(\mu_{100})_0 - \log(\mu_{100})_{0.4}}{0.4} \ (1/\ddot{O}e)$$

wherein $(\mu_{100})_0$ is the magnetic permeability in the absence of the bias magnetic field and $(\mu_{100})_{0.4}$ is the magnetic permeability under the application of a bias magnetic field of 0.4 e,uml/O/ e.

TABLE 1

| Example No. | Alloy Composition (atomic %) | $\mu_{100}$ | Hc (Oe) | $V_H$ | 180° Bending Property | Shape: Circularity (%) | Shape: Diameter Variation (%) |
|---|---|---|---|---|---|---|---|
| Comp. Ex. 1 | $(Co_{0.94}Fe_{0.06})_{72.5}Si_{12.5}B_{15}$ | 1820 | 0.036 | 2.01 | possible | 96 | 1.3 |
| Comp. Ex. 2 | $(Co_{0.9365}Fe_{0.063}Mo_{0.0005})_{72.5}Si_{12.5}B_{15}$ | 1810 | 0.037 | 1.94 | " | 96 | 1.2 |
| Ex. 1 | $(Co_{0.93}Fe_{0.065}Mo_{0.005})_{72.5}Si_{12.5}B_{15}$ | 1815 | 0.058 | 0.24 | " | 97 | 1.0 |
| Comp. Ex. 3 | $(Co_{0.93}Fe_{0.065}Mo_{0.005})_{72.5}Si_{12.5}B_{15}$ | 800 | 0.003 | 2.57 | " | 1 | — |
| Ex. 2 | $(Co_{0.91}Fe_{0.06}Mo_{0.03})_{72.5}Si_{12.5}B_{15}$ | 1805 | 0.073 | 0.30 | " | 97 | 1.3 |
| Comp. Ex. 4 | $(Co_{0.91}Fe_{0.06}Mo_{0.03})_{72.5}Si_{12.5}B_{15}$ | 800 | 0.007 | 2.64 | " | 1 | — |
| Comp. Ex. 5 | $(Co_{0.875}Fe_{0.055}Mo_{0.07})_{72.5}Si_{12.5}B_{15}$ | 925 | 0.096 | 0.23 | breaks | 96 | 1.2 |
| Comp. Ex. 6 | $(Co_{0.9365}Fe_{0.063}Ni_{0.0005})_{72.5}Si_{12.5}B_{15}$ | 1760 | 0.038 | 1.90 | possible | 96 | 1.2 |
| Ex. 3 | $(Co_{0.928}Fe_{0.067}Ni_{0.005})_{72.5}Si_{12.5}B_{15}$ | 1730 | 0.065 | 0.29 | " | 96 | 1.1 |
| Ex. 4 | $(Co_{0.894}Fe_{0.076}Ni_{0.03})_{72.5}Si_{12.5}B_{15}$ | 1715 | 0.071 | 0.28 | " | 96 | 1.2 |
| Comp. Ex. 7 | $(Co_{0.894}Fe_{0.076}Ni_{0.03})_{72.5}Si_{12.5}B_{15}$ | 750 | 0.005 | 2.16 | " | 1 | — |
| Comp. Ex. 8 | $(Co_{0.843}Fe_{0.087}Ni_{0.07})_{72.5}Si_{12.5}B_{15}$ | 905 | 0.098 | 0.28 | " | 95 | 1.2 |
| Comp. Ex. 9 | $(Co_{0.9365}Fe_{0.063}Cr_{0.0005})_{72.5}Si_{12.5}B_{15}$ | 1790 | 0.037 | 1.96 | " | 96 | 1.1 |
| Ex. 5 | $(Co_{0.93}Fe_{0.065}Cr_{0.005})_{72.5}Si_{12.5}B_{15}$ | 1775 | 0.062 | 0.38 | " | 96 | 1.2 |
| Ex. 6 | $(Co_{0.91}Fe_{0.06}Cr_{0.03})_{72.5}Si_{12.5}B_{15}$ | 1720 | 0.070 | 0.36 | " | 97 | 1.0 |
| Comp. Ex. 10 | $(Co_{0.91}Fe_{0.06}Cr_{0.03})_{72.5}Si_{12.5}B_{15}$ | 780 | 0.004 | 2.37 | " | 1 | — |
| Comp. Ex. 11 | $(Co_{0.875}Fe_{0.055}Cr_{0.07})_{72.5}Si_{12.5}B_{15}$ | 840 | 0.096 | 0.35 | " | 96 | 1.2 |
| Comp. Ex. 12 | $(Co_{0.93}Fe_{0.065}Cr_{0.005})_{90}Si_5B_5$ | — | — | — | breaks | 94 | 1.4 |
| Comp. Ex. 13 | $(Co_{0.93}Fe_{0.065}Cr_{0.05})_{72}Si_{23}B_5$ | — | — | — | " | 95 | 1.4 |
| Ex. 7 | $(Co_{0.907}Fe_{0.063}Cr_{0.01}Mo_{0.02})_{72.5}Si_{12.5}B_{15}$ | 1785 | 0.058 | 0.32 | possible | 96 | 1.2 |
| Ex. 8 | $(Co_{0.93}Fe_{0.065}Ni_{0.002}Cr_{0.003})_{72.5}Si_{12.5}B_{15}$ | 1750 | 0.063 | 0.31 | " | 97 | 1.2 |
| Ex. 9 | $(Co_{0.93}Fe_{0.065}Ni_{0.002}Mo_{0.003})_{72.5}Si_{12.5}B_{15}$ | 1765 | 0.061 | 0.29 | " | 97 | 1.1 |
| Comp. Ex. 14 | $(Co_{0.9365}Fe_{0.063}Nb_{0.0005})_{72.5}Si_{12.5}B_{15}$ | 1815 | 0.037 | 1.96 | " | 97 | 1.1 |
| Ex. 10 | $(Co_{0.93}Fe_{0.065}Nb_{0.005})_{72.5}Si_{12.5}B_{15}$ | 1940 | 0.060 | 0.22 | " | 97 | 1.2 |
| Comp. Ex. 15 | $(Co_{0.93}Fe_{0.065}Nb_{0.005})_{72.5}Si_{12.5}B_{15}$ | 950 | 0.003 | 2.56 | " | 1 | — |
| Ex. 11 | $(Co_{0.91}Fe_{0.06}Nb_{0.03})_{72.5}Si_{12.5}B_{15}$ | 1870 | 0.069 | 0.24 | " | 98 | 1.1 |
| Comp. Ex. 16 | $(Co_{0.91}Fe_{0.06}Nb_{0.03})_{72.5}Si_{12.5}B_{15}$ | 700 | 0.004 | 2.43 | " | 1 | — |
| Comp. Ex. 17 | $(Co_{0.875}Fe_{0.055}Nb_{0.07})_{72.5}Si_{12.5}B_{15}$ | 900 | 0.094 | 0.25 | breaks | 95 | 1.3 |
| Ex. 12 | $(Co_{0.93}Fe_{0.065}Nb_{0.005})_{74.5}Si_{16.5}B_9$ | 1820 | 0.057 | 0.25 | possible | 96 | 1.1 |
| Ex. 13 | $(Co_{0.93}Fe_{0.065}Nb_{0.005})_{75}Si_{7.5}B_{17}$ | 1825 | 0.056 | 0.27 | " | 97 | 1.0 |
| Comp. Ex. 18 | $(Co_{0.93}Fe_{0.065}Nb_{0.005})_{90}Si_5B_5$ | — | — | — | breaks | 95 | 1.2 |
| Comp. Ex. 19 | $(Co_{0.93}Fe_{0.065}Nb_{0.005})_{72}Si_{23}B_5$ | — | — | — | " | 92 | 1.4 |
| Comp. Ex. 20 | $(Co_{0.9365}Fe_{0.063}Ta_{0.0005})_{72.5}Si_{12.5}B_{15}$ | 1810 | 0.038 | 1.93 | possible | 96 | 1.2 |
| Ex. 14 | $(Co_{0.93}Fe_{0.065}Ta_{0.005})_{72.5}Si_{12.5}B_{15}$ | 1800 | 0.051 | 0.42 | " | 97 | 1.0 |
| Ex. 15 | $(Co_{0.91}Fe_{0.06}Ta_{0.03})_{72.5}Si_{12.5}B_{15}$ | 1790 | 0.054 | 0.36 | " | 97 | 1.0 |

TABLE 1-continued

| Example No. | Alloy Composition (atomic %) | $\mu_{100}$ | Hc (Oe) | $V_H$ | 180° Bending Property | Shape Circularity (%) | Shape Diameter Variation (%) |
|---|---|---|---|---|---|---|---|
| Comp. Ex. 21 | $(Co_{0.878}Fe_{0.052}Ta_{0.07})_{72.5}Si_{12.5}B_{15}$ | 890 | 0.085 | 0.29 | breaks | 96 | 1.0 |
| Comp. Ex. 22 | $(Co_{0.9365}Fe_{0.063}Pd_{0.0005})_{72.5}Si_{12.5}B_{15}$ | 1810 | 0.037 | 1.95 | possible | 95 | 1.4 |
| Ex. 16 | $(Co_{0.935}Fe_{0.06}Pd_{0.005})_{72.5}Si_{12.5}B_{15}$ | 1790 | 0.052 | 0.60 | " | 95 | 1.3 |
| Comp. Ex. 23 | $(Co_{0.935}Fe_{0.06}Pd_{0.005})_{72.5}Si_{12.5}B_{15}$ | 735 | 0.007 | 2.37 | " | 1 | — |
| Ex. 17 | $(Co_{0.91}Fe_{0.06}Pd_{0.03})_{72.5}Si_{12.5}B_{15}$ | 1750 | 0.068 | 0.52 | " | 96 | 1.3 |
| Comp. Ex. 24 | $(Co_{0.91}Fe_{0.06}Pd_{0.03})_{72.5}Si_{12.5}B_{15}$ | 690 | 0.009 | 2.29 | " | 1 | — |
| Comp. Ex. 25 | $(Co_{0.87}Fe_{0.06}Pd_{0.07})_{72.5}Si_{12.5}B_{15}$ | 850 | 0.084 | 0.48 | breaks | 95 | 1.3 |
| Comp. Ex. 26 | $(Co_{0.9395}Fe_{0.06}Pt_{0.0005})_{72.5}Si_{12.5}B_{15}$ | 1800 | 0.038 | 1.91 | possible | 96 | 1.1 |
| Ex. 18 | $(Co_{0.935}Fe_{0.06}Pt_{0.005})_{72.5}Si_{12.5}B_{15}$ | 1760 | 0.056 | 0.30 | " | 96 | 1.0 |
| Ex. 19 | $(Co_{0.91}Fe_{0.06}Pt_{0.03})_{72.5}Si_{12.5}B_{15}$ | 1720 | 0.064 | 0.28 | " | 97 | 1.0 |
| Comp. Ex. 27 | $(Co_{0.87}Fe_{0.06}Pt_{0.07})_{72.5}Si_{12.5}B_{15}$ | 840 | 0.095 | 0.25 | breaks | 95 | 1.3 |
| Comp. Ex. 28 | $(Co_{0.9395}Fe_{0.06}Cu_{0.0005})_{72.5}Si_{12.5}B_{15}$ | 1790 | 0.039 | 1.88 | possible | 95 | 1.4 |
| Ex. 20 | $(Co_{0.935}Fe_{0.06}Cu_{0.005})_{72.5}Si_{12.5}B_{15}$ | 1700 | 0.061 | 0.35 | " | 96 | 1.1 |
| Comp. Ex. 29 | $(Co_{0.935}Fe_{0.06}Cu_{0.005})_{72.5}Si_{12.5}B_{15}$ | 700 | 0.008 | 2.28 | " | 1 | — |
| Ex. 21 | $(Co_{0.91}Fe_{0.06}Cu_{0.03})_{72.5}Si_{12.5}B_{15}$ | 1690 | 0.072 | 0.31 | " | 96 | 1.0 |
| Comp. Ex. 30 | $(Co_{0.91}Fe_{0.06}Cu_{0.03})_{72.5}Si_{12.5}B_{15}$ | 650 | 0.013 | 2.20 | " | 1 | — |
| Comp. Ex. 31 | $(Co_{0.87}Fe_{0.06}Cu_{0.07})_{72.5}Si_{12.5}B_{15}$ | 870 | 0.084 | 0.29 | breaks | 94 | 1.6 |
| Comp. Ex. 32 | $(Co_{0.9344}Fe_{0.065}Nb_{0.0003}Ta_{0.0003})_{72.5}Si_{12.5}B_{15}$ | 1790 | 0.038 | 1.93 | possible | 95 | 1.3 |
| Ex. 22 | $(Co_{0.925}Fe_{0.065}Nb_{0.005}Ta_{0.005})_{72.5}Si_{12.5}B_{15}$ | 1780 | 0.062 | 0.23 | " | 96 | 1.1 |
| Ex. 23 | $(Co_{0.905}Fe_{0.065}Nb_{0.02}Ta_{0.01})_{72.5}Si_{12.5}B_{15}$ | 1805 | 0.065 | 0.21 | " | 97 | 1.0 |
| Comp. Ex. 33 | $(Co_{0.855}Fe_{0.065}Nb_{0.05}Ta_{0.03})_{72.5}Si_{12.5}B_{15}$ | 800 | 0.090 | 0.20 | breaks | 96 | 1.0 |
| Comp. Ex. 34 | $(Co_{0.9394}Fe_{0.06}Pd_{0.0003}Cu_{0.0003})_{72.5}Si_{12.5}B_{15}$ | 1770 | 0.039 | 1.90 | possible | 94 | 1.3 |
| Ex. 24 | $(Co_{0.93}Fe_{0.06}Pd_{0.005}Cu_{0.005})_{72.5}Si_{12.5}B_{15}$ | 1660 | 0.059 | 0.38 | " | 95 | 1.3 |
| Ex. 25 | $(Co_{0.91}Fe_{0.06}Pd_{0.02}Cu_{0.01})_{72.5}Si_{12.5}B_{15}$ | 1600 | 0.067 | 0.56 | " | 95 | 1.2 |
| Comp. Ex. 35 | $(Co_{0.86}Fe_{0.06}Pd_{0.03}Cu_{0.05})_{72.5}Si_{12.5}B_{15}$ | — | — | — | breaks | 93 | 1.7 |

It is clearly seen from Table 1 that in Examples 1, 2, 4, 6, 10, 11, 16, 17, 20, and 21, the $V_H$ values are much smaller than those in Comparative Examples 3, 4, 7, 10, 15, 16, 23, 24, 29, and 30, respectively. In other words, amorphous metallic ribbons have larger $V_H$ values than fine amorphous metallic wires of the same alloy composition, and stability to a bias magnetic field is inherent in the fine amorphous metallic wires of this invention having a circular cross section.

In Examples 1 to 25, the $V_H$ values are from 0.2 to 0.6 which are much smaller than the $V_H$ value of 2.01 in Comparative Example 1 in which no M element was added, and the stability to a bias magnetic field is very great. For example, the decreases of magnetic permeability in Comparative Example 1, Example 2, and Comparative Example 4 under influence of a bias magnetic field were as follows. In Comparative Example 1, $\mu_{100}$ was 1820 in the absence of a bias magnetic field, but decreased to 286 when a bias magnetic field of 0.4 Öe was applied. In Comparative Example 3, $\mu_{100}$ was 800 in the absence of a bias magnetic field, but decreased to 70 when a bias magnetic field of 0.4 Öe was applied. In contrast, in Example 2, $\mu_{100}$ was 1805 in the absence of a bias magnetic field, and 1370 even when a bias magnetic field of 0.4 Öe was applied; furthermore, the decrease of magnetic permeability was very small.

Since Comparative Examples 8, 11, 14, 20, 22, 26, 28, 32, and 34 had compositions outside the present invention, the decrease of magnetic permeability under a bias magnetic field was large, and the $V_H$ values were accordingly large. In Comparative Examples 5, 12, 13, 17–19, 21, 25, 27, 31, 33, and 35, the compositions were outside the scope of the invention. Hence, the products had poor toughness and could not be bent by 180° bending property. In particular, the alloys in Comparative Examples 12, 13, 18, 19, and 35 did not become amorphous, but crystallized. They were brittle and did not show soft magnetism.

While the invention has been described in detail and with reference to specific embodiments thereof, it will be apparent to one skilled in the art that various changes and modifications can be made therein without departing from the spirit and scope thereof.

What is claimed is:

1. A fine magnetic amorphous metal wire having a circular cross section and stability to a bias magnetic field, said wire being composed of an alloy having the composition formula $$(Co_{1-a-b}Fe_aM_b)_{100-x-y}Si_xB_y$$

wherein M is at least one element selected from Cr, Mo, Ni, Nb, Ta, Pd, Pt, and Cu, $x<20$ atomic%, 7 atomic% $\leqq y<35$ atomic%, 7 atomic% $<x+y\leqq 35$ atomic%, $0.01\leqq a\leqq 0.1$, and $0.001\leqq b\leqq 0.05$.

2. A fine magnetic amorphous metal wire as in claim 1, wherein b is at least 0.003 but not more than 0.04.

3. A fine magnetic amorphous metal wire as in claim 1, wherein $x+y$ is at least 15 atomic% but not more than 32 atomic%.

4. A fine magnetic amorphous metal wire as in claim 1, wherein y is at least 7.5 atomic % but not more than 25 atomic%.

5. A fine magnetic amorphous metal wire as in claim 1, wherein the wire has a circularity of at least 60%.

6. A fine magnetic amorphous metal wire as in claim 1, wherein the wire has a circularity of at least 80%.

7. A fine magnetic amorphous metal wire as in claim 1, wherein the wire has a circularity of at least 90%.

8. A fine magnetic amorphous metal wire as in claim 1, wherein said wire has a $V_H$ value of not more than 1.5.

9. A fine magnetic amorphous metal wire as in claim 1, wherein said wire has a $V_H$ value of not more than 1.2.

10. A fine magnetic amorphous metal wire as in claim 1, wherein said wire has a $V_H$ value of not more than 0.75.

* * * * *